US005812061A

United States Patent [19]

Simons

[11] Patent Number: 5,812,061

[45] Date of Patent: Sep. 22, 1998

[54] SENSOR CONDITION INDICATING SYSTEM

[75] Inventor: Richard W. Simons, Golden Valley, Minn.

[73] Assignee: Honeywell Inc., Minneapolis, Minn.

[21] Appl. No.: 802,456

[22] Filed: Feb. 18, 1997

[51] Int. Cl.[6] ..... G08B 5/22

[52] U.S. Cl. ..... 340/815.45; 340/524; 340/578; 340/815.69; 431/24; 431/80

[58] Field of Search ..... 340/461, 462, 340/511, 514, 515, 516, 517, 524, 525, 815.45 OR, 815.58, 815.69, 577, 578; 431/13, 14, 18, 24, 80

[56] References Cited

U.S. PATENT DOCUMENTS

| | | | |
|---|---|---|---|
| 4,639,717 | 1/1987 | De Meirsman | 340/578 |
| 4,823,114 | 4/1989 | Gotisar | 340/578 |
| 5,025,466 | 6/1991 | Hillogoss et al. | 379/21 |
| 5,039,978 | 8/1991 | Kronberg | 340/815.69 |
| 5,126,721 | 6/1992 | Butcher et al. | 340/578 |
| 5,236,328 | 8/1993 | Tate et al. | 431/24 |
| 5,439,374 | 8/1995 | Jamieson | 431/24 |

*Primary Examiner*—Daniel J. Wu
*Attorney, Agent, or Firm*—Edward L. Schwarz

[57] ABSTRACT

A sensor provides a status signal indicating a condition of an operating system to the operating system's control system. The sensor has an inherent variable quantity such as resistance whose magnitude indicates the operating system status. The control system includes a user-operable switch which when actuated signals the microprocessor to determine the approximate value of the sensor's variable quantity. The magnitude of the variable quantity is then indicated by a signal comprising one or more beeps of sound or flashes of light. The number of beeps or flashes indicates the approximate present magnitude of the sensor's variable quantity. In a preferred embodiment, the control system comprises a microprocessor programmed to control the operating system and to perform most of the functions of the invention.

15 Claims, 3 Drawing Sheets

SENSOR CONDITION INDICATING SYSTEM

BACKGROUND OF THE INVENTION

A variety of operating systems with which all are familiar, are now controlled electronically. Common household devices such as dishwashers, television sets, and furnaces depend heavily on electronic control systems to function properly. In the typical situation, the present status of the operating system is indicated by one or more sensors which measure parameters of the operating system. The sensors produce output signals which measure the parameter to which the sensors respond, to thereby indicate operating system status. These output signals are supplied to the control system, and form the basis for the control activities.

Such sensors each have an inherent variable quantity whose magnitude depends on a particular aspect of the operating system's current status, in essence measuring this status value. For example—and this is the actual system for which this invention was developed—a typical furnace control receives signals from the thermostat and the flame sensor, and exercises its control of the furnace based on these signals. There may well be other sensors as well which are provided for purposes of safety and efficiency. Such other sensors may measure temperature of exiting air, air flow velocity, etc.

It has become cost effective to use the powerful, reliable, and inexpensive microprocessors available today for these various control tasks. Microprocessors can be easily programmed to handle almost any type of control task. Once the programming for a particular task has been done, it is easy and cheap to make the instructions available to such a microprocessor. When the instructions are loaded, the microprocessor becomes the functional equivalent of a custom circuit designed for the specific control task. Since such microprocessors are manufactured literally by the millions, their cost is typically a fraction of a custom circuit's cost. And when it is desired to alter their functions, it is much easier to reprogram a microprocessor than to redesign a custom circuit.

The sensors which supply status signals may be any of a number of different devices. Some may produce a voltage or current directly, which changes as the particular operating system parameter. In the particular situation which gave rise to this invention, the sensor is a cadmium sulfide (CdS) cell for detecting flame in a furnace or boiler. A CdS cell has a resistance which decreases with increasing intensity of visible light which strikes a sensing area of the sensor. Experience shows that the resistance of such cells tends to increase over a period of usage. If the cell is not replaced, it is possible that eventually the CdS cell resistance when flame is present will not fall to a level which indicates presence of flame in the furnace. The furnace controller will interpret this resistance level as indicating that flame is not present, and respond by closing the main fuel valve. This is the safe mode of failure, but still undesirable, since such failures usually require an expensive emergency service call.

Whenever a furnace fails to light, there are usually a number of possible causes for the malfunction, and a defective CdS cell (where this type of flame sensor is used) is only one. In order to repair a defective burner as quickly as possible, the service person attempts to eliminate each possible cause of the malfunction as quickly as possible. Heretofore, it has been difficult to easily identify a CdS cell as the cause of the malfunction. One way of course is simply to replace the cell in the burner. Another way is for the service person to expose the CdS cell to the visible light to which it is sensitive, and measure the change in its internal resistance. This is also inconvenient and time consuming for a number of reasons. The CdS cell must be disconnected from the controller. The cell normally should be tested while within the furnace itself, making it inconvenient to determine whether the cell is malfunctioning. Thus, both of these procedures are poor solutions since they each are somewhat time-consuming and of course, if the CdS cell is functioning properly, won't even solve the problem.

Furnaces and boilers typically receive yearly maintenance and tune-up, and this is the most cost-effective time to replace deteriorating parts of all types. Since the CdS cells are known to deteriorate over time, it is customary to check their condition during these routine maintenance calls. The previous inconvenient process by which CdS cell condition is checked increases the cost of this routine maintenance. Again, one can simply replace the CdS cell at scheduled intervals, but since CdS cells age and deteriorate at different rates, this means that many perfectly good cells will be replaced. And replacing a cell at scheduled intervals, while not hugely expensive, still does increase the overall cost of operating the burner.

One cost involved with installing a new CdS cell is that of aligning the cell with the burner flame. Because of the poor accessibility which the combustion chamber of a burner often provides, this is not always easy to do visually. Instead of relying on visual alignment, frequently the service person will while flame is present, monitor the cell resistance with an ohmmeter, and adjust the cell position until the resistance reaches a minimum or at least falls below a predetermined level. This too is inconvenient, and requires the cell to be disconnected from the controller and its resistance monitored until a particular position of the CdS cell results in internal resistance below the predetermined value mentioned above. The ability to quickly and easily monitor the actual cell resistance simplifies and improves this alignment process.

A further consideration involves the design paradigms of many types of control systems. A numeric display may well cost an appreciable percentage of the cost of the control itself. Where there are no user-adjustable parameters, it is customary to forego the added cost of providing more than a simple power light or indicator to signal operating status. And the user input device for many types of these controls may often be no more than a simple on-off switch. Adding further user inputs creates the possibility of user confusion and error and of course adds cost as well. This one switch input limits the amount of communication which a user has with the controller and provides a further impediment to testing of the system and its components.

BRIEF DESCRIPTION OF THE INVENTION

Given these cost and technical constraints, it is still desirable to allow for some indication of sensor malfunctions. This desire can be further extended to providing an indication of the status or value of a wide variety of other types of analog signals arising in the actions of operating systems. I have found that a satisfactory indication of a signal level can frequently be provided by a single on-off signaling device such as a light or a beeper.

Accordingly, my invention comprises apparatus for signaling the approximate numeric value encoded in a variable input signal. Such signaling apparatus comprises what I call a value differentiator receiving the input signal. The value differentiator defines a plurality of preferably non-overlapping value ranges within one of which the input signal's numeric value may fall. The value differentiator provides a range signal encoding one of a predetermined finite set of indicator values, where each of the indicator values correspond to a single value range of the input signal. A signaling unit receives the range signal, and provides a human perceptible signal comprising a number of similar discrete indications dependent on the indicator value encoded in the range signal. In the customary situation, these discrete indications are flashes of light provided by a light emitting diode (LED), but could also comprise a number of beeps from a buzzer or other sound generator.

In a preferred embodiment, the value differentiator comprises a computer, typically a microprocessor, having at least first and second software-based test elements. Each test element has assigned to it a predetermined value range and the indicator value which corresponds to that value range. Each of the test elements is designed to compare the resistance value encoded in the input signal with that test element's predetermined value range. Each test element responsive to the resistance value falling within the test element's value range, provides a range signal encoding the predetermined indicator value assigned thereto. Preferably, the range signal value increases with larger end values for the value range within which the value in the input signal falls.

A part of the signal generator also comprises the same microprocessor comprising the value differentiator. After the microprocessor has performed the functions of the value differentiator, software causes the microprocessor to issue discrete power pulses to a signaling device such as the LED to cause perceptible indications, where the number of power pulses equals the indicator value in the range signal.

DESCRIPTION OF THE PREFERRED EMBODIMENTS

Figure 1:
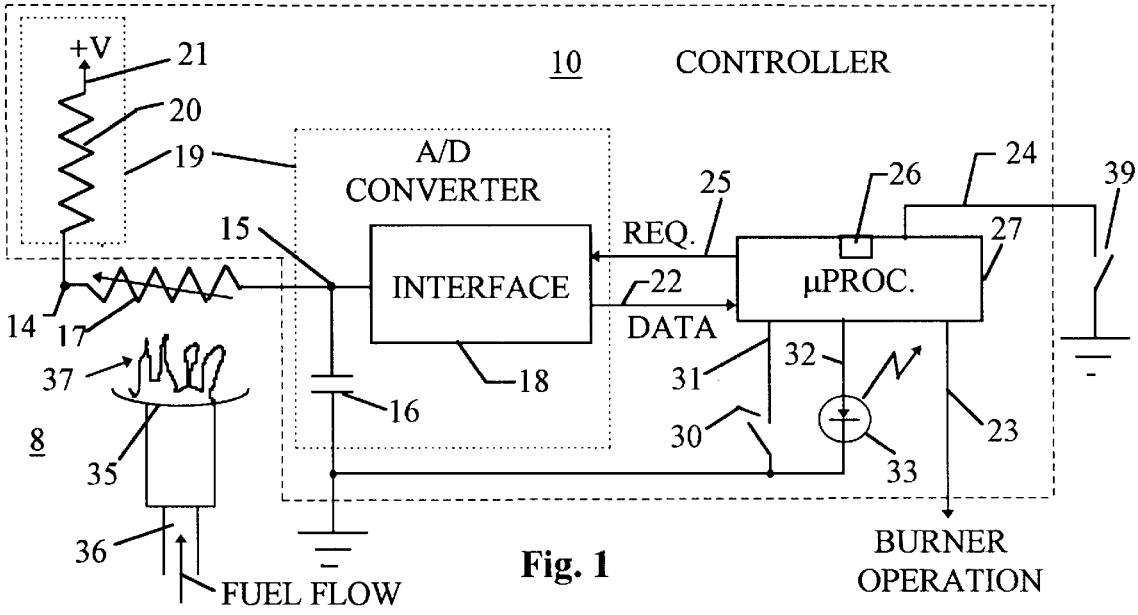
FIG. 1 is a block diagram of a control system in which the invention is implemented.

The block diagram in FIG. 1 shows the parts of a burner or furnace system 8 and its associated controller 10 necessary to understand the invention. Burner system 8 includes a burner 35 typically designed to burn fuel oil. Fuel flows through a supply pipe 36 to the burner 35. A flame detector cell 17 is represented as a variable resistor whose resistance changes with changing intensity of visible light. Cell 17 typically comprises a cadmium sulfide (CdS) sensor appropriately positioned relative to a flame 37 which fuel flow supports, to permit sensing of the flame 37. A CdS sensor cell resistance decreases with increasing light intensity. When functioning properly, resistance of a particular CdS sensor for use as cell 17 in a preferred embodiment varies from substantially less than 250 ohms when flame 37 is present to more than 5000 ohms when flame 37 is not present. Thus, measuring cell 17 resistance provides a suitable means for detecting flame 37.

The entire operation of burner system 8 is controlled by controller 10 which includes an A/D converter 19, a microprocessor 27, a momentary contact switch 30 and a status-indicating light emitting diode (LED) 33. Microprocessor 27 is programmed with a set of pre-recorded instructions in an instruction memory (not shown) to provide the various control signals which control the activities of an operating burner system 8. Microprocessor 27 is also an important component of the invention forming the subject of this patent.

CdS cell 17 resistance is conventionally measured by the A/D converter 19 which uses the varying resistance of cell 17 to vary the time required to charge a capacitor 16 of known capacitance. The time required to charge capacitor 16 can be correlated with the resistance of cell 17 according to well known principles of electronics. A/D converter 19 includes a voltage source 21 which is connected by a resistor 20 to a first terminal 14 of cell 17.

The A/D converter 19 further comprises the capacitor 16 whose first terminal is connected to the second terminal 15 of cell 17, and whose second terminal is connected to ground. A/D converter 19 also includes an interface 18 which electrically connects microprocessor 27 to capacitor 16. A request (REQ.) signal on path 25 from microprocessor causes interface 18 to rapidly discharge capacitor 16 to very nearly ground voltage. Current supplied by voltage source 21 then more slowly charges capacitor 16, and at a rate depending on among other parameters, the present resistance of cell 17. Interface 18 provides a data (DATA) signal to microprocessor 27 on a path 22. The data signal comprises a change in voltage level on path 22, and this voltage level change occurs at the instant the capacitor 16 voltage reaches a preset voltage. The length of the charging interval between the request signal and the level change in the data signal indicates the resistance of cell 17.

Microprocessor 27 also forms a portion of A/D converter 19, but is not easily represented as such in FIG. 1. The charging interval is measured by an internal clock in microprocessor 27, and from the length of this interval microprocessor 27 derives the resistance of cell 17 according to known theory. The use of interface 18 allows much more precise measurement of cell 17 resistance. This is a conventional implementation of an A/D converter, and no further discussion is required for those with skill in the art.

In addition to implementing major portions of this invention, microprocessor 27 also furnishes the controller's control function for the furnace system of which burner 35 forms a part. In so doing, it is necessary for microprocessor 27 to communicate with external devices. Conventionally, microprocessor 27 communicates with these external devices through a number of input and output communication registers, each register comprising a number of bits. The values in output register bits are set by the microprocessor 27 during instruction execution to provide one of two voltage levels for sensing or other use by external devices. A typical microprocessor 27 operates on a low DC voltage such as 5 v. It is convenient to use ground and an intermediate DC voltage, say 3 v. to represent the two binary values or logic states for the output communication register bits. Input register bits have input terminals to which external devices can be connected. When an external device provides an appropriate signal to an input register bit's input terminal, the contents of that bit changes to indicate that input signal level. The contents of each input register bit can be sensed by the microprocessor 27 circuitry by executing the appropriate instructions.

In fulfilling its overall function of providing control signals for burner system 8, microprocessor 27 has a number of distinct tasks to perform of which the sensor resistance indicator (SRI) task routine forming the instant invention is but one. Each task is performed by executing a set of instructions recorded in the microprocessor memory and dedicated to that task. Such a set of instructions will be called a task routine. It is customary for a microprocessor such as microprocessor 27 to select task routines for execution by providing a core routine which I will call a task selector, which directs instruction execution to the various task routines. As each task routine completes its execution, it re-enters the task selector at a preset instruction. Executing the task selector instructions performs a preselected set of sequential logic tests, the results of which determine the task routine next ready for execution. In addition to the SRI task routine forming the subject of this invention, there are a number of burner control task routines whose execution cause the burner operation signals to be provided on signal path(s) 23.

There are typically three different types of conditions used by the task selector in selecting task routines for execution. The first two types are individual logic flags which the task selector periodically tests, each of which is associated with a particular task routine. One state of each of these flag satisfies the criterion for transferring instruction execution to its associated task routine and the other does not. The first type of logic flag is set by external devices such as for example, switch 30. There are also internal flip-flop flags often a part of internal registers, which are also periodically tested by the task selector, and which are set by executing task routines.

The third type of condition uses the internal clock which microprocessors usually have, allowing the task selector to select task routines according to time-related criteria. Times for the next execution of each of these task routines are recorded at preselected memory locations. Periodically the task selector compares the individual task execution times recorded for each of the task routines with the internal clock time, and when the time to execute the task routine arrives, the task selector transfers control to that task. Execution times may be set by the task selector to provide for execution of individual task routines at fixed intervals. The next time for execution of a task routine may also be variable and set by another task routine.

It is well to now briefly discuss the way in which the reader should view microprocessor 27. First of all, microprocessor 27 of course has a well-defined, if for the most part microscopic, physical structure. While executing the instructions of a task routine, microprocessor 27 functionally and physically becomes individual components or elements dedicated to performing that task. Thus, as this invention is described in FIGS. 1 and 2, each of the components providing functions arising from instruction execution by microprocessor 27, has a physical existence as the microprocessor 27 itself during execution of the instructions providing that component's function. In essence, the microprocessor 27 becomes first one and then another of these components while executing the corresponding instructions recorded within its instruction memory. The signals between the individual components are in fact internal microprocessor signals recorded in the microprocessor's data memory while the microprocessor changes "hats" so to speak by switching from one component's instructions to another. Both the instruction execution and the data signals cause actual physical changes to occur in the memories involved while they are present, and in this sense also the microprocessor-based component performing each task has an actual physical existence.

It is also important to realize that many of the individual components of the task routines including the invention as described herein are most definitely not off-the-shelf items, and that no standardized terms for such components exist. I have chosen terms descriptive of the function(s) for these components which microprocessor 27 functionally becomes. For example, the reader will see below that the component in FIG. 2 called test element 1 (ref. no. 40) can test whether the digital value provided by the A/D converter 19 is between 0 and 250 ohms, and if so, provide a range signal encoding a logical 1 indicator value. There is a part of the task routine comprising the invention which causes microprocessor 27 to function as test element 1, and indeed each of the components shown in FIGS. 1 and 2 arise from microprocessor 27 executing sets of instructions.

There are many different ways in which each of the components comprising the invention may be implemented. While shown here as for the most part arising from instruction execution by microprocessor 27, it is also possible to implement the invention as a custom circuit. The reader should understand that the specific implementation disclosed for these elements is likely one of literally hundreds, and that it is neither practical nor statutorily required to disclose each and every one of them in order to achieve the scope of patent protection to which I believe I am entitled. When a particular component not having a known presence in the art is first mentioned, its function will be described and my intent is to include any of these various embodiments within that description.

With this discussion in mind, turn again to FIG. 1. Normal operation of burner system 8 is initiated by a call for heat by a conventional thermostat represented in this diagram as comprising a switch 39 which is connected between ground and the input terminal of an input channel bit or input register bit of microprocessor 27. Closing switch 39 in response to the temperature ambient to thermostat 39 grounds this input terminal and changes the state of the bit. The new state of this bit is detected by the task selector. Instruction execution transfers to a burner startup task routine which upon completing various activities such as opening a fuel valve and igniting the fuel flowing to burner 8.

This invention employs momentary contact switch 30 which when actuated provides an initiate signal by grounding an input terminal 31 of an input register bit of microprocessor 27. The initiate signal begins the process of implementing the resistance indication provided by this invention. In my preferred embodiment switch 30 is also used to manually initiate restart of the burner system 8 after a control system lockout, typically arising due to malfunction such as a failure of the fuel to ignite during burner startup. Microprocessor 27 can easily determine the desired purpose for which switch 30 has been actuated by checking the state of a mode register which has been set previously to indicate the malfunction. A light emitting diode (LED) 33 connected to the output terminal of an output data bit of microprocessor 27 provides a sequence of light flashes indicating the approximate resistance of sensor 17. LED 33 is shown symbolically in the light emitting state. The output register bits of microprocessor 27 have sufficient current output to light LED 33.

Microprocessor 27 has an internal register which functions as a mode flag 26. The numeric value recorded in mode flag 26 is set by burner control task routines to any of a number of different values. The value recorded in mode flag 26 indicates the present mode of the burner system 8. Examples of modes are standby, ignition, run, and lockout. Standby mode arises when thermostat switch 39 is open. Lockout mode arises typically when a malfunction occurs, perhaps repeatedly. Ignition mode is active while an igniter (not shown) is lighting fuel flowing to burner 35 during a startup phase of operation immediately after switch 39 has closed.

The user operates the invention as disclosed by FIG. 1 by closing switch 30 and providing a ground or 0 v. signal to input terminal 31. If the microprocessor 27 has placed burner system 8 in any operating mode other than lockout, then the microprocessor 27 transmits a request signal on path 25 which causes the A/D converter 19 to sense the resistance of cell 17 and provide a digital input signal on data path 22 encoding the resistance of cell 17. Microprocessor 27 compares the cell 17 resistance signal on path 22, and determines within which resistance range of a plurality of resistance ranges, cell 17 resistance falls. A small integral value is assigned to each of these ranges (see table below). Microprocessor 27 causes LED 33 to blink a number of times equal to the integral value assigned to the resistance range within which the cell 17 resistance falls. This is done by setting and clearing the output register bit having output terminal 32 an appropriate number of times. Obviously, the number of blinks and the value ranges can be varied as desired to provide the most useful indications. I have found that it is most useful for the specific application here, that the resistance ranges are contiguous. I have also found that the larger the end points of the resistance value range within which cell 17 resistance falls, the larger should be the number of blinks assigned to it.

Figure 2:
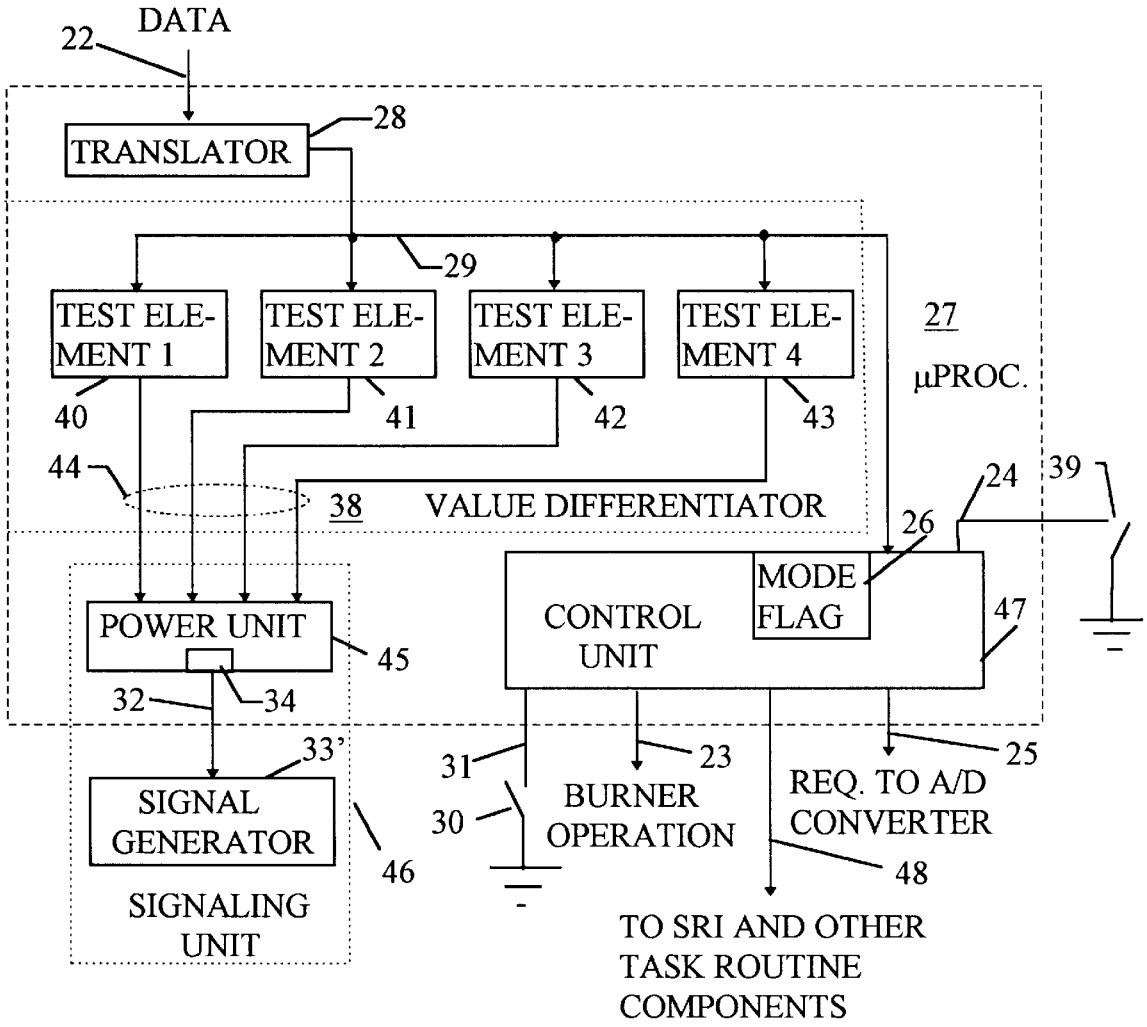
FIG. 2 is a block diagram of the individual functional elements of a microprocessor in which the invention is implemented.

FIG. 1 shows a very generalized hardware version of the invention with little detail for microprocessor 27. The functional block diagram of FIG. 2 shows the individual components which microprocessor 27 comprises while executing the SRI task routine. These include a control unit 47 which provides control signals carried on paths shown generally at 48 to all of the components formed by microprocessor 27 including those shown in FIG. 2. The control unit 47 control signals on paths 48 initiate and sequence the activities of the microprocessor 27 so as to create the individual components. Control unit 47 also communicates with components external to microprocessor 27. Thus, switches 30 and 39, paths 23 carrying signals for controlling burner system 8 operation, and the request signal path 25 are all shown connected to control unit 47. Control unit 47 also includes the mode flag 26.

Control unit 47 responds to the signal on input terminal 31 created by closing switch 30 by providing the request signal on path 25 to A/D converter 19 and at nearly the same time starts an internal timer. This request signal is nothing more than the changed output of an output communication register bit. In response to this changed output, interface circuit 18 starts charging capacitor 16. When capacitor 16 reaches a preselected voltage level, interface circuit 18 discharges capacitor 16 and provides the data signal on path 22. The data signal sets a bit of an input communication register, and this changed bit is immediately detected by control unit 47. Control unit 47 immediately records the value present in the timer which was started when the request signal was sent. A translator 28 converts to a digital resistance value the timer value, which is the time between the request signal issued on path 25 and the data signal on path 22 returned by A/D converter 19. This resistance value is encoded in a resistance signal on path 29 and sent to value differentiator 38. Within microprocessor 27, test elements 1–4 40–43 cooperatively form the value differentiator 38.

Each of the test elements 1–4 40–43 has assigned to it a predetermined resistance or value range as indicated in the table below. When the resistance value in the input signal on path 22 falls within that range, the test element involved provides an output signal which indicates that condition. The other test elements each provide a signal indicating that the resistance value falls outside of their specified range. The output signals produced by test elements 1–4 40–43 collectively form a range signal carried on path 44 and which encodes an indicator value specifying the number of discrete power pulses which a power unit 45 is to transmit in a power signal on path 32. This range signal can take many other equally acceptable formats in encoding the indicator values, and there is no need for one skilled in the art to have concern with the details of the encoding.

The power signal is provided to a signal generator 33' and causes a series of visible flashes (LED 33 shown in FIG. 1) or audible beeps or buzzes. The number of flashes or beeps equals the indicator value and in my preferred embodiment is selected according to the following table:

| Resistance Range (Value Range) | Test Element | Indicator Value, Number of Power Pulses, and Number of Blinks |
|---|---|---|
| 0–249 ohms | 1 | 1 |
| 250–749 ohms | 2 | 2 |
| 750–1999 ohms | 3 | 3 |
| 2000 or more ohms | 4 | 4 |

The power signal in this embodiment comprises one, two, three, or four discrete power pulses as indicated in the table above depending on the indicator value encoded in the range signal from the test elements 1–4 40–43.

As explained above, microprocessor 27 sequentially executes object code which causes it to physically become each of these test elements in turn. (Obviously, if the input signal's encoded value falls within the test element's assigned value range, then none of the as yet inactive test elements need operate for that comparison.) Power unit 45 is also a part of microprocessor 27 and typically will comprise one bit (hereafter, the signaling bit 34) of an output channel in microprocessor 27. The individual bits of an output communication register of a typical microprocessor can easily supply the few tens of milliamps. which a small LED requires. Microprocessor 27 while functioning as power unit 45 executes a series of instructions which set signaling bit 34 for a brief period of time, perhaps half a second to a second, and then clears signaling bit for a similar time interval. If two, three, or four blinks are required, then this sequence of instructions is repeated the appropriate number of times. The output voltage from signaling bit 34 forms the power signal on path 32 to signal generator 33'.

It can be seen from the table above that each of the resistance (value) ranges are contiguous and non-overlapping, and for the present system this is preferred. However, it is possible that in certain circumstances it may be desirable to have non-contiguous value ranges.

I earlier mentioned a related set of operating system control functions performed by control unit 47. While most of these functions are unrelated to this invention, there is one feature which bears mention. This is the mode flag 49 which forms a part of control unit 47. The furnace or boiler to be controlled by this control system has a number of distinct normal operating modes, examples being run, ignition, and off. In run mode a main fuel valve is open to allow fuel flow through pipe 36 to sustain flame 37 of burner 35. In the particular system for which this invention was developed, ignition mode causes the main fuel valve to open, fuel to flow to burner 35, and an igniter to operate to ignite the fuel and initiate flame 37. In the off mode, the main fuel valve is closed, and no fuel at all is flowing to burner 35. There is also an abnormal mode called the lockout mode which the control unit 47 enters after any of a number of malfunctions, say if ignition does not occur within a specified time, or if flame is lost unexpectedly after a normal startup. When lockout mode occurs, safe practice requires human intervention to restart the system. This is usually done by requiring the momentary contact switch 30 to be closed thereby providing a reset signal to microprocessor 27. An operating status code is present in the mode flag 49 which identifies the present operating status of the furnace.

As mentioned in the discussion of FIG. 1, switch 30 provides both the reset signal for exiting the lockout mode, and the initiate signal for beginning the activities for indicating resistance of sensor 17. When the mode flag 26 does not indicate lockout, then the signal on path 31 caused by closing switch 30 is treated as an initiate signal by control unit 47. When the mode flag does indicate lockout mode, then control unit 47 begins the process for starting operation of burner system 8 if thermostat switch 39 is closed.

Figure 3:
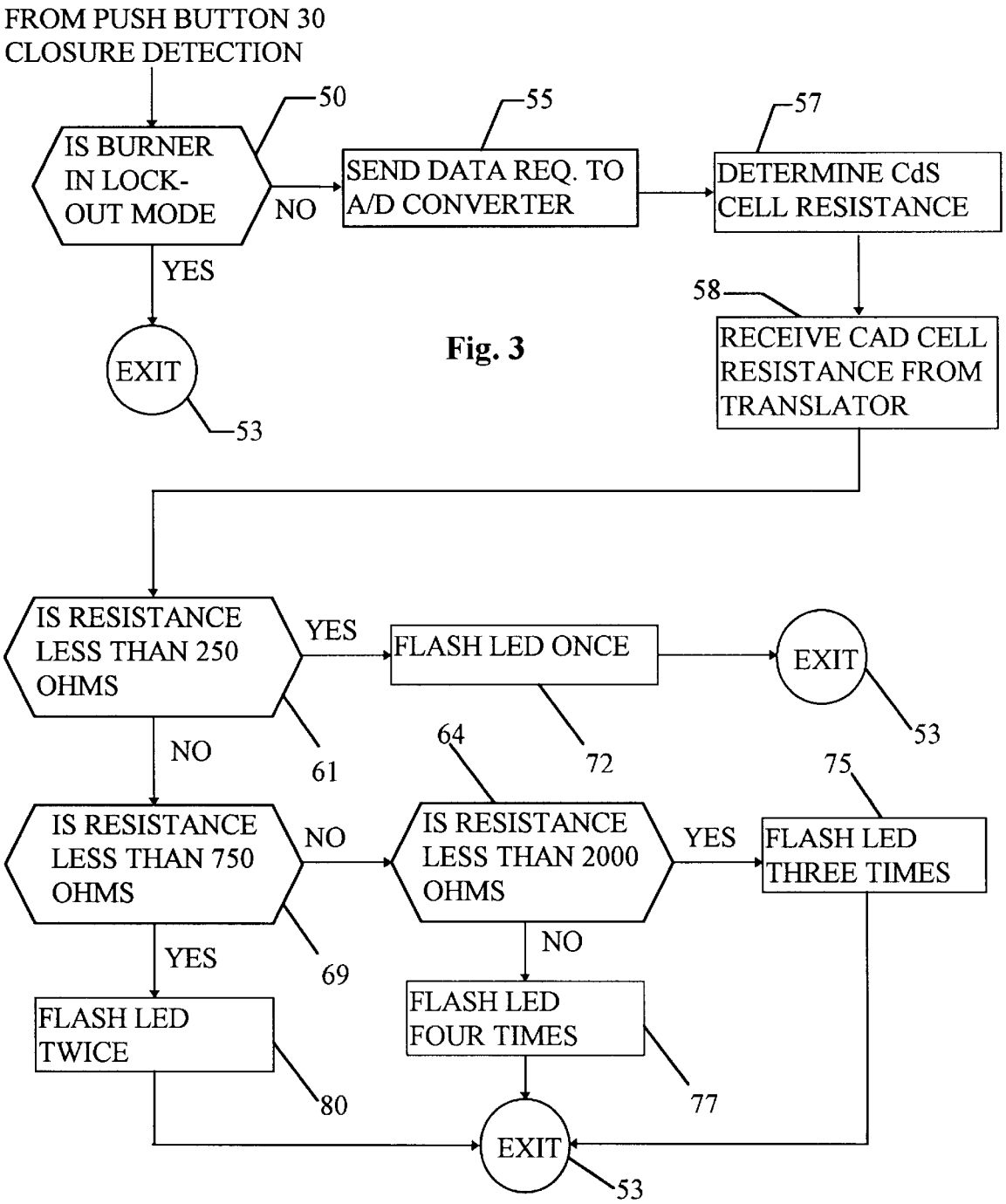
FIG. 3 is a flowchart of a program which the microprocessor can execute when implementing the invention.

All of this will become more clear during the explanation of the software elements in the flowchart of FIG. 3. Most of these software elements have counterparts in the hardware block diagram of FIG. 2. All of these software elements are implemented by instructions within microprocessor 27. In FIG. 3, there are three types of elements. Decision elements such as element 50 perform some sort of test of data within microprocessor 27 and continue instruction execution at one of two different instruction sequences depending on the results of that test. Decision elements are shown as hexagonal boxes. Activity elements such as element 55 cause some type of computational activity to occur. Activity elements are shown as rectangular boxes. Lastly, exit elements 53 denote a return to executing instructions forming the task selector.

When switch 30 is closed, the input register bit having input terminal 31 is set. The task selector will periodically examine this input register bit, and when it is found to be set, the task selector transfers instruction execution to decision element 50. Decision element 50 symbolizes instructions causing microprocessor 27 to test the value in the mode flag register 26. If this value indicates that the system is in lockout mode, then instruction execution transfers to the task selector as indicated by the arrow to exit element 53. If the burner is not in lockout mode, then the instructions which activity element 55 represents are executed. Activity element 55 instructions cause microprocessor 27 to set the output register bit whose output is placed on path 25. A/D converter 19 receives the request signal on path 25 and charges capacitor 16 to a preset level, at which time the data signal is sent to translator 28. Activity element 57 symbolizes the instructions which comprise translator 28. The activity element 58 instructions cause microprocessor 27 to sense the data signal on path 22 when it appears, determine the time between the request and data signals, calculate CdS cell 17 resistance, and provide the resistance signal on path 29.

Decision elements 61, 64, and 69 collectively represent instructions which cause microprocessor 27 to become the value differentiator 38 of FIG. 2. Activity elements 72, 75, 77, and 80 represent instructions which implement power unit 45 shown in FIG. 2. Decision element 61 instructions implement test element 40 within value differentiator 38 by testing whether the resistance value calculated by the instructions of activity element 57 is less than 250 ohms. If so, then execution continues with the instructions activity element 72, which causes microprocessor 27 to issue a single power pulse to LED 33. If resistance is at least 250 ohms, then instruction execution continues with those of decision element 69, which test the resistance value to be less than 750 ohms, that is to say, in the range of 250 to 749 ohms as for test element 2 41 of FIG. 2. If cell 17 resistance is within this range, then the instructions of activity element 80 are executed, causing microprocessor 27 to issue two power pulses to LED 33. Similarly, one can see that decision element 64 instructions perform a test of the resistance value which corresponds to the function of test element 3 42. If resistance is in the range of 750 ohms to 1999 ohms decision element 64 transfers execution to the instructions of activity element 75 causing LED 33 to flash three times. If cell 17 resistance is 2000+ ohms, then the instructions of decision element 64 transfers execution to the instructions of activity element 77, this causes LED 33 to flash four times. In each case, after the instructions associated with each of the activity elements for flashing LED 33 have been executed, instruction execution transfers back to the task selector via exit element 53.

In this way, the microprocessor 27 can cause the cell 17 resistance to be measured and LED 33 to be flashed a number of times which is indicative of the approximate cell 17 resistance. Of course, there are any number of different ways to organize the instructions in a microprocessor to provide the same functionality as that displayed by executing the instructions represented by the flowchart elements of FIG. 3. All of these different implementations should be considered to be equivalent to that shown in this description. Furthermore, the variants for the individual element groups in FIGS. 1 and 2 should all be considered equivalent. For example, the instructions which implements value differentiator 38 need not follow the structure represented in FIG. 3.

The following has described my invention; what I wish to claim is:

1. Apparatus for signaling the approximate value of an input signal encoding a variable numeric value, comprising:

a) a value differentiator receiving the input signal, and providing a range signal encoding one of a predetermined finite set of indicator values, the selection of an indicator value depending on which one of a plurality of predetermined, non-overlapping, value ranges the numeric value encoded in the input signal falls within;

b) a signaling unit receiving the range signal, and providing a human perceptible signal comprising a number of similar discrete indications dependent on the indicator value encoded in the range signal.

2. The signaling apparatus of claim 1, wherein the signaling unit comprises:

a) a signal generator emitting at least one of sound and visible light responsive to a power signal; and b) a power unit receiving the range signal, and providing to the signal generator a power signal comprising at least one discrete power pulse, wherein the number of power pulses is dependent on the indicator value encoded in the range signal.

3. The signaling apparatus of claim 2 wherein the value differentiator provides a range signal encoding a numeric indicator value, and wherein the indicator value is larger for value ranges having a larger smallest numeric value, wherein the indicator value corresponding to each value range is different from every other indicator value, and wherein the power unit provides a number of power pulses equal to the indicator value encoded in the range signal.

4. The signaling apparatus of claim 3 adapted to approximately indicate the resistance value of a variable resistor, and comprising a) a resistance detector electrically connected to the variable resistor and providing a resistance signal whose level indicates the present resistance value of the variable resistor;

b) an A/D converter receiving the resistor signal and digitally encoding the resistance value in the input signal supplied to the value differentiator.

5. The apparatus of claim 4, wherein the value differentiator comprises a computer having at least first and second software-based test elements, each test element having assigned to it a predetermined value range and the indicator value corresponding thereto, each of the test elements being designed to compare the resistance value encoded in the input signal with that test element's predetermined value range, and each test element responsive to the resistance value falling within the test element's value range, providing a range signal encoding the predetermined indicator value assigned thereto.

6. The apparatus of claim 4 wherein the first test element is of the type providing a range signal to the power unit causing the power unit to send one power pulse to the signaling unit, and wherein the first test element's threshold value is smaller than the second test element's threshold value.

7. The apparatus of claim 6, wherein the value ranges assigned to the first and second test elements are non-overlapping.

8. The apparatus of claim 5, wherein the value ranges assigned to the first and second test elements are non-overlapping.

9. The apparatus of claim 2, wherein the value ranges defined by the value differentiator are non-overlapping.

10. A control system for controlling the operation of an operating system, said operating system having a) a sensor having a variable electrical parameter indicative of operating system status;

b) a converter-connected to the sensor for providing a sensor signal encoding the electrical parameter value; and said control system including c) a switch for supplying a mode select signal; and d) a control unit receiving the mode select signal and including a mode flag register recording at least first and second values set by the control unit and corresponding respectively to first and second modes of operation of the operating system, and supplying a mode flag signal encoding the value in the mode flag register, said control unit setting the mode flag register to the first value responsive to the mode select signal; and wherein the invention comprises in the control system e) a value differentiator receiving the sensor signal, and providing a range signal encoding one of a predetermined finite set of indicator values, the selection of an indicator value depending on which one of a plurality of predetermined, non-overlapping, value ranges the parameter value encoded in the sensor signal falls within;

f) a signaling unit receiving the range signal and an initiate signal, and responsive to the initiate signal, providing a human perceptible signal comprising at least one of a plurality of similar discrete indications, the number of said discrete indications provided dependent on the indicator value encoded in the range signal; and g) a logic element receiving the mode select signal and the mode flag register signal, and responsive to the mode select signal and the first value of the mode flag register signal, issuing an initiate signal.

11. The control system of claim 10, wherein the associations between a particular indicator value and a value range, and between the particular indicator value and the number of similar discrete indications are both predetermined.

12. The control system of claim 11 wherein the discrete indications are flashes of light.

13. A control system for controlling the operation of an operating system, said operating system having a) a sensor having a variable electrical parameter indicative of operating system status;

b) a converter connected to the sensor for providing a sensor signal encoding the electrical parameter value; and said control system including c) a switch for supplying a mode select signal; and d) a control unit receiving the mode select signal and including a mode flag register recording at least first and second values set by the control unit and corresponding respectively to first and second modes of operation of the operating system, and supplying a mode flag signal encoding the value in the mode flag register, said control unit setting the mode flag register to the first value responsive to the mode select signal; and wherein the invention comprises in the control system e) a value differentiator receiving the sensor signal and an initiate signal, and responsive to the initiate signal, providing a range signal encoding one of a predetermined finite set of indicator values, the selection of an indicator value depending on which one of a plurality of predetermined, non-overlapping, value ranges the parameter value encoded in the sensor signal falls within;

f) a signaling unit receiving the range signal and providing a human perceptible signal comprising at least one of a plurality of similar discrete indications, the number of said discrete indications provided dependent on the indicator value encoded in the range signal; and g) a logic element receiving the mode select signal and the mode flag register signal, and responsive to the mode select signal and the first value of the mode flag register signal, issuing an initiate signal.

14. The control system of claim 13, wherein the associations between a particular indicator value and a value range, and between the particular indicator value and the number of similar discrete indications are both predetermined.

15. The control system of claim 14 wherein the discrete indications are flashes of light.

* * * * *